US007193147B2

(12) United States Patent
Ishida

(10) Patent No.: US 7,193,147 B2
(45) Date of Patent: Mar. 20, 2007

(54) STRING-STRIKING DEVICE FOR PIANO

(75) Inventor: Muneo Ishida, Hamamatsu (JP)

(73) Assignee: Kabushiki Kaisha Kawai Gakki Seisakusho, Shizuoka (JP)

( * ) Notice: Subject to any disclaimer, the term of this patent is extended or adjusted under 35 U.S.C. 154(b) by 0 days.

(21) Appl. No.: 10/566,024

(22) PCT Filed: Jul. 16, 2004

(86) PCT No.: PCT/JP2004/010211

§ 371 (c)(1),
(2), (4) Date: Jan. 25, 2006

(87) PCT Pub. No.: WO2005/013258

PCT Pub. Date: Feb. 10, 2005

(65) Prior Publication Data

US 2007/0012155 A1 Jan. 18, 2007

(30) Foreign Application Priority Data

Jul. 30, 2003 (JP) ..... 2003-282938

(51) Int. Cl.
*G10F 1/02* (2006.01)

(52) U.S. Cl. ..... 84/35

(58) Field of Classification Search ..... 84/423 R, 84/236, 34–48, 105, 111, 167, 174, 432, 433
See application file for complete search history.

(56) References Cited

U.S. PATENT DOCUMENTS 4,667,563 A * 5/1987 Wakuda et al. ..... 84/439

FOREIGN PATENT DOCUMENTS

| | | |
|---|---|---|
| JP | 2001-159894 | 6/2001 |
| JP | 2002-162970 | 6/2002 |
| JP | 2003-216143 | 7/2003 |

OTHER PUBLICATIONS

Kawai News Release 'Upright Piano "Varitouch" Hatsubai ni tsuite', [online], Heisei 15 nen 5 Gatsu 28 Nichi, [retrieval date Aug. 03, 2004], internet<URL:http://www.kawai.co.jp/press/release20030528.html>.

* cited by examiner

*Primary Examiner*—Kimberly Lockett
(74) *Attorney, Agent, or Firm*—Davis Bujold & Daniels, P.L.L.C.

(57) ABSTRACT

A keystroke device of a piano capable of increasing an area for the adjustment of static loads applied to the tips of keys on the playing sides, wherein a first weight lever (31) rotating according to the movement of the keys (21) is installed above the keys (21) and near an action part (25) and a second weight lever (41) rotating according to the movement of the first weight lever (31) is installed above the first weight lever. Since the second weight lever (41) can be separated from the action part (25), the degree of freedom of the shape and installation of the second weight lever (41) can be increased. Accordingly, the area for the adjustment of the static loads applied to the tips of the keys (21) on the playing sides can also be increased.

4 Claims, 1 Drawing Sheet

STRING-STRIKING DEVICE FOR PIANO

This application is a national stage completion of PCT/JP2004/0010211 filed Jul. 16, 2004 which claims priority from Japanese Application Ser. No. 2003-282938 filed Jul. 30, 2003.

TECHNICAL FIELD

This invention relates to a string-striking device for a piano which enables the adjustment of the static loading (force) applied to a fore-end on the playing side of a key.

BACKGROUND ART

The Applicant had previously filed an invention relating to a string-striking device for a piano which allows easy adjustment of the static loading applied to a fore-end on the playing side of a key (Japanese Patent Application No. 2002-330816, which is referred to as a preceding application hereinafter). This string-striking device for a piano is provided with a long weight lever, one for every key. The long weight lever is disposed along the length direction of the key of the piano above the side opposite to the playing side of the key. One end of the weight lever is fixed to a piano body so as to allow the weight lever to freely swing up and down. The other open end, which can be vertically displaced, is brought into contact with the upper surface of the key and applies its own weight to the key.

In the above string-striking device for a piano, since the weight lever is provided above the key and applies a weight on the key, the static loading of the key can be adjusted by replacing the weight lever or by replacing the plummets attached to the weight lever, instead of replacing the leads buried within the key as before. Moreover, moving the weight lever along the length direction of the key results in change of a distance between the contact point with the key and the rotation axis of the weight lever. Therefore, easy adjustment of the static loading can be achieved without replacing the weight lever.

DISCLOSURE OF THE INVENTION

Problems to be Solved by the Invention

The weight lever is required to be arranged on the side opposite to the playing side of the key. However, the action is already installed on the side. Therefore, the installation space for the weight lever is extremely limited. Because of this limited installation space, there are limitations in the installation position, the size, and the movable range of the weight lever. Accordingly, there is large restriction in the adjustable range of the static loading applied to the fore-end on the playing side of the key.

The present invention was made to solve these problems. One object of the present invention is to provide a string-striking device for a piano which allows broadening of the adjustable range of the static loading applied to a fore-end on the playing side of a key.

Means to Solve the Problems

In order to solve the above problems, a string-striking device for a piano, according to Claim 1, is provided with a first weight lever and a second weight lever. The first weight lever is disposed along the length direction of a key of the piano, above the side opposite to the playing side of the key. The first weight lever is arranged such that one end thereof is fixed to a piano body so as to allow the first weight lever to freely swing up and down. The other open end of the first weight lever, which can be vertically displaced, is brought into contact with the upper surface of the key and applies its own weight to the key. The second weight lever is arranged such that one end thereof is fixed to a piano body so as to allow the second weight lever to freely swing up and down. The other open end of the second weight lever, which can be vertically displaced, is brought into contact with the upper surface of the first weight lever and applies its own weight to the first weight lever. The second weight lever is a long weight lever which swings in conjunction with the swing of the first lever. The swing herein means partial rotation in both rotational directions on a fixed point.

In the above constitution, when the side opposite to the playing side of the key is raised as a result of key operation by a player, the first weight lever firstly starts the upward rotational motion in response to the force from the key. Further, the second weight lever starts the upward rotational motion in response to the force from the first weight lever. Such a constitution allows the second weight lever to be disposed at a position farther from the key (more particularly, the action) than the first weight lever. This means that there is a lot of flexibility in shape and installation of the second weight lever. Moreover, the first weight lever is released from the task of increasing the static loading. The shape and the installation position of the first weight lever can be adapted to the purpose of efficiently transmitting the motion of the key to the second weight lever. Accordingly, the string-striking device for a piano of the present invention is said to not only maintain the easiness of adjusting the static loading applied to a fore-end on the playing side of a key in the same manner as the string-striking device for a piano described in the preceding application filed by the Applicant, but also have a feature that the adjustable range of the static loading is fairly broad.

If the player strikes the key very hard, the second weight lever jumps up high and then requires time to return to the position where the second weight lever touches the first weight lever again. The player may feel uncomfortable by this. Accordingly, as described in Claim 2, it is preferable that the string-striking device of the present invention is provided with a long stopper rail that is secured to the piano body above the second weight lever so that the stopper rail extends over a plurality of second weight levers and restricts the upward swing of the plurality of second weight levers.

With the stopper rail as above, the rotation amount of the second weight lever can be restricted so that the second weight lever does not jump up so high. That is, it is possible to appropriately adjust the time required for the second weight lever to return to a state in which the second weight lever touches the first weight lever again, by changing the set position of the stopper rail. A favorable touch and feel can be provided to the player.

Adjustment of the static loading applied to a fore-end on the playing side of a key can be conducted by changing weight of the first weight lever and the second weight lever (e.g., by replacing the plummet portion or by replacing the weight lever itself). However, the manner of changing the weight as above requires a trouble of removing or disassembling the weight lever. Accordingly, as described in Claim 3, the second weight lever may be secured to the piano body by a moving mechanism such that the second weight lever can move in the length direction of the key. Particularly, for example, it is preferable that the second weight lever is secured to a movable rail and secured to the piano body via the movable rail.

In this manner, the movement of the second weight lever enables change in distance between the rotation axis of the second weight lever and the contacting position between the first weight lever and the second weight lever. Accordingly, the static loading applied to the fore-end on the playing side of the key can be easily adjusted rather than by changing the weight of the first weight lever and the second weight lever.

As described in Claim 4, it is further preferable that an operating lever is provided outside the piano. The operation of the operating lever when operated may be transmitted to the moving mechanism so as to move the second weight lever.

In the device constituted as above, adjustment of the static loading can be performed only by the operation of the operating lever. Therefore, the player can adjust the static loading even in the intervals between plays.

BRIEF DESCRIPTION OF THE DRAWINGS

FIG.1 is an explanatory view of a string-striking device for a grand piano according to an embodiment.

EXPLANATION OF REFERENCES

Figure 1:
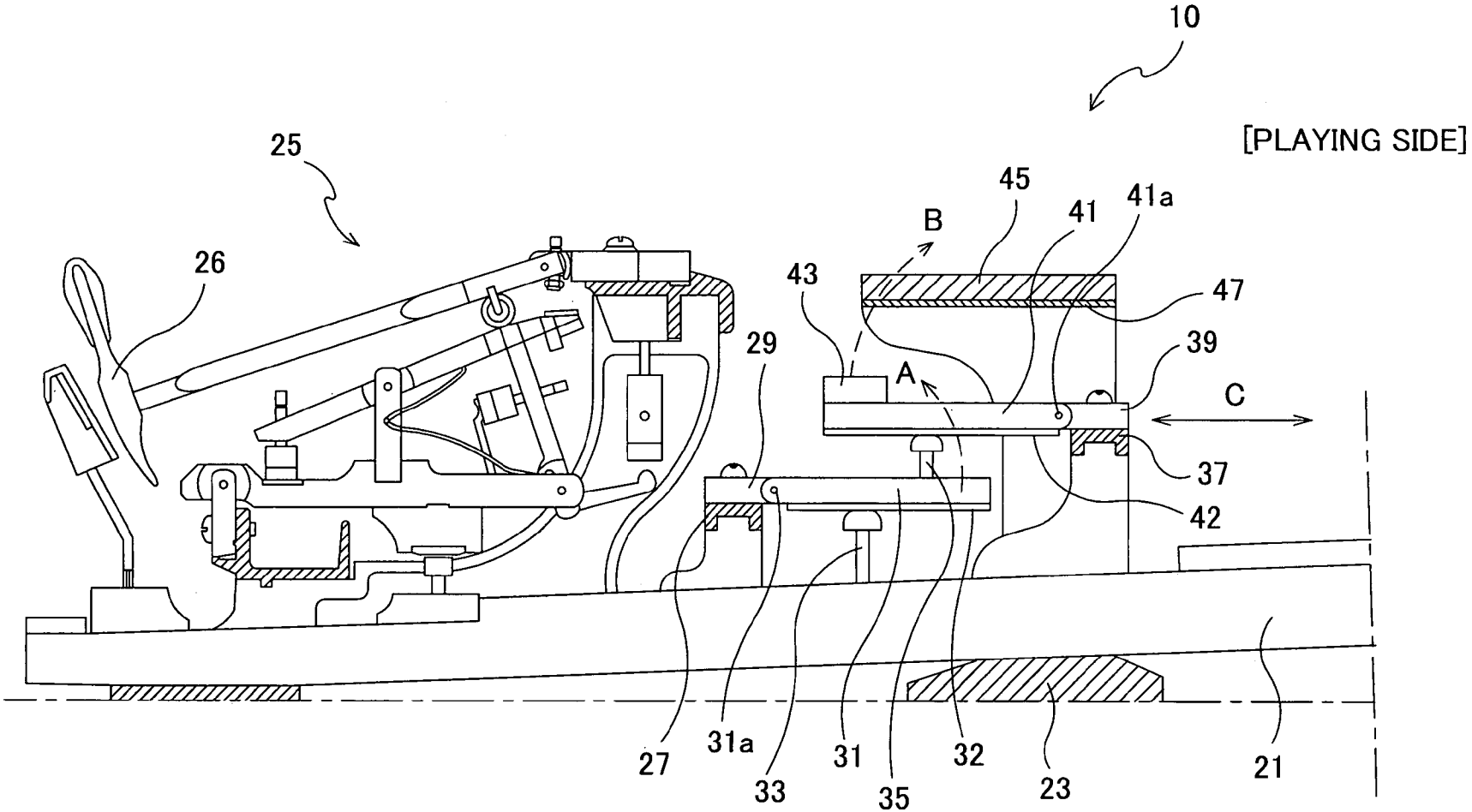
[FIG. 1]

10 . . . string-striking device, 21 . . . key, 23 . . . intermediate plate, 25 . . . action portion, 26 . . . hammer, 27 . . . first fixed rail, 29 . . . flange, 31 . . . first weight lever, 31*a* . . . connecting portion, 32 . . . felt, 33 . . . screw, 35 . . . screw, 37 . . . second fixed rail, 39 . . . flange, 41 . . . second weight lever, 41*a* . . . connecting portion, 42 . . . felt, 43 . . . plummet, 45 . . . stopper rail, 47 . . . felt

BEST MODE FOR CARRYING OUT THE INVENTION

An embodiment of the present invention will be described below, by way of the drawing. The present invention is not limited to the below embodiment, and other modifications and variations may be possible within the technical scope of the invention.

FIG. 1 is a side view showing a string-striking device 10 for a grand piano. As shown in FIG. 1, the string-striking device 10 mainly includes a key 21, an action portion 25, a first weight lever 31, a second weight lever 41, and a stopper rail 45.

The piano has a total of 88 individual keys 21. Each key 21 is arranged to pivot on an intermediate plate 23 acting as a fulcrum. When a key 21 is depressed, the side opposite (action side) to the playing side of the key 21 is raised to transmit the key depression to the action portion 25. When the key depression is transmitted to the action portion 25, string-striking operation is performed in which a hammer 26 provided in the action portion 25 hits a string (not shown).

The first weight lever 31 is swingably fastened to a first fixed rail 27 (which is secured to the piano body at both ends by brackets and provided on the playing side near the action portion 25 to extend over a plurality of keys 21) via a flange 29. The first weight lever 31 is fastened such that the swinging side thereof is on the playing side of the key 21. The first weight lever 31 is held by a screw 33 which is screwed into the key 21 so that the rotational motion due to gravity of the first weight lever 31 is restrained. The height of the screw 33 (i.e., the length of protrusion from the key 21) can be adjusted by adjusting the amount screwed into the key 21 of the screw 33.

A screw 35 is provided on the first weight lever 31 and supports the second weight lever 41. The height of the screw 35 (i.e., the length of protrusion from the first weight lever 31) can be also adjusted by adjusting the amount screwed into the first weight lever 31 of the screw 35. Felt 32 is attached to the undersurface of the first weight lever 31 so as to reduce the undesirable sound generated when the first weight lever 31 hits the screw 33.

The second weight lever 41 is swingably fastened to a second fixed rail 37 (which is secured to the piano body at both ends by brackets and provided near the first weight lever 31 to extend over a plurality of keys 21) via a flange 39. The second weight lever 41 is fastened such that the swinging side thereof is on the action side of the key 21. The brackets supporting the second fixed rail 37 are secured to the piano body via a movable rail (not shown). This movable rail corresponds to a moving mechanism described in Claims. An operating lever (not shown) provided beside the keyboard of the piano is connected to an end of this movable rail. The second weight lever 41 can be moved in parallel to the key 21 (see the arrow C) by the operation of the operating lever. This operating lever can be formed into any shape as long as it can be operated by a human being. For example, the operating lever may be shaped as a wheel. The second weight lever 41 is held by the screw 35 which is screwed into the first weight lever 31 so that the rotational motion due to gravity of the second weight lever 41 is restrained. Also, a plummet 43 made of material like iron and lead is provided on a fore-end on the swinging side of the second weight lever 41. The plummet 43 serves to increase the weight (more precisely, inertia moment) of the second weight lever 41. Also, felt 42 is attached to the undersurface of the second weight lever 41 so as to reduce the undesirable sound generated when the second weight lever 41 hits the screw 35.

The stopper rail 45 is provided above the second weight lever 41 and extends over a plurality of second weight levers 41. Both ends of the stopper rail 45 are secured to the piano body by brackets. Felt 47 is attached to the undersurface of the stopper rail 45 so as to reduce the undesirable sound generated when the stopper rail 45 hits the second weight lever 41.

The string-striking device 10 constituted as such operates as below. When a key 21 is depressed by a player, the action side of the key 21 is raised. The motion is transmitted to the action portion 25, which then operates the hammer 26 to hit the string.

As the action side of the key 21 is raised, the screw 33 is also raised. Together with the ascent of the screw 33, the first weight lever 31 rotates in a direction indicated by an arrow A on a connecting portion 31*a* which connects the first weight lever 31 to the flange 29. When the first weight lever 31 rotates in the direction indicated by the arrow A, the second weight lever 41 is pushed up via the screw 35. The second weight lever 41 rotates in a direction indicated by an arrow B on a connecting portion 41*a* which connects the second weight lever 41 to the flange 39. In this regard, even if the action side of the key 21 is started to descend, the second weight lever 41 continues to rotate independently of the descent of the action side of the key 21 if sufficient rotational force is given to the second weight lever 41. The same applies to the case when the first weight lever 31 starts to descend. The second weight lever 41 continues to rotate, until the second weight lever 41 hits the stopper rail 45. Once the second weight lever 41 hits the stopper rail 45, the second weight lever 41 discontinues rotation. After the rotation is discontinued, the second weight lever 41 rotates in a direction opposite to the arrow B due to gravity, until the second weight lever 41 abuts on the screw 35.

Additionally, by operating the operating lever provided beside the keyboard of the piano, the second weight lever 41 moves in parallel to the key 21. As a result, it is possible to change the contacting position between the second weight lever 41 and the screw 35. Accordingly, if the second weight lever 41 is moved to the action side from the center position within the movable range of the second weight lever 41, the distance between the rotation axis (connecting portion 41*a*) of the second weight lever 41 and the contacting position where the second weight lever 41 is brought into contact with the screw 35 is shortened, thus increasing the rotation amount of the second weight lever 41 with respect to the amount depressed by the key 21. That is, the static loading of the key 21 is increased. To the contrary, if the second weight lever 41 is moved to the playing side from the center position within the movable range of the second weight lever 41, the distance between the rotation axis (connecting portion 41*a*) of the second weight lever 41 and the contacting position where the second weight lever 41 is brought into contact with the screw 35 is lengthened, thus reducing the rotation amount of the second weight lever 41 with respect to the amount depressed by the key 21. That is, the static loading of the key 21 is decreased.

In the string-striking device 10 constituted as above, the second weight lever 41 can be installed at a position farther from the key (more particularly, the action) than the first weight lever 31. Therefore, there is a lot of flexibility in shape and installation of the second weight lever. Accordingly, in the string-striking device 10, the range in which the static loading applied to the fore-end on the playing side of the key 21 is adjusted is substantially broad as compared to the string-striking device described in the preceding application by the Applicant, which includes only a single type of the weight lever (i.e., only the first weight lever in the present embodiment).

Moreover, simple operation of the operating lever provided beside the keyboard of the piano moves the second weight lever 41. Thus, the static loading applied to a fore-end on the playing side of the key 21 can be easily adjusted.

Other embodiments are shown below.

(1) In the above embodiment, the stopper rail 45 is not moved when the operating lever provided beside the keyboard of the piano is operated. However, the stopper rail 45 as well may be moved in conjunction with the second weight lever 41 and the second fixed rail 37. In this manner, the position where the stopper rail 45 is brought into contact with the weight lever 41 can be fixed. Thus, the stopper rail 45 can be made small.

(2) The directions (the direction of the swinging side) in which the first weight lever 31 and the second weight lever 41 are installed can be any direction as long as there is sufficient installation space. For example, the second weight lever 41 may be arranged in a direction opposite to the direction shown in the aforementioned embodiment. That is, the second weight lever 41 may be arranged on the playing side and the second fixed rail 37 may be arranged on the action side, so that the action side of the second weight lever 41 may swing. In this manner, the rotational directions of the respective first weight lever 31 and second weight lever 41 may coincide with each other. Since there is less displacement due to rotation in the contact point between the first weight lever 31 and the second weight lever 41 (more precisely, the contact point between the screw 35 and the second weight lever 41), the touch and feel of the player can be also improved.

(3) In the above embodiment, the string-striking device 10 is applied to a grand piano. However, the similar type of the string-striking device 10 may be applied to an upright piano.

INDUSTRIAL AVAILABILITY

The present invention can provide a string-striking device for a piano which expands the adjustable range of the static loading applied to a fore-end on the playing side of a key.

The invention claimed is:

1. A string-striking device for a piano, comprising a long first weight lever and a long second weight lever, each one for every key, the first weight lever being disposed along a length direction of a key of the piano, above a side opposite to a playing side of the key, and arranged such that one end of the first weight lever is fixed to a piano body so as to allow the first weight lever to freely swing up and down, and the other open end of the first weight lever, which can be vertically displaced, is brought into contact with an upper surface of the key and applies its own weight to the key, and the second weight lever, which swings in conjunction with swing of the first lever, being arranged such that one end of the second weight lever is fixed to the piano body so as to allow the second weight lever to freely swing up and down, and the other open end of the second weight lever, which can be vertically displaced, is brought into contact with an upper surface of the first weight lever and applies its own weight to the first weight lever.

2. The string-striking device for a piano according to claim 1, wherein further comprising a long stopper rail that is secured to the piano body above the second weight lever so that the stopper rail extends over a plurality of second weight levers and restricts upward swing of the plurality of second weight levers.

3. The string-striking device for a piano according to claim 1, wherein the second weight lever is secured to the piano body by a moving mechanism such that the second weight lever can move in the length direction of the key.

4. The string-striking device for a piano according to claim 3, wherein further comprising an operating lever outside the piano, wherein the operation of the operating lever when operated is transmitted to the moving mechanism so as to move the second weight lever.

* * * * *